United States Patent [19]

McGarry et al.

[11] 4,113,554

[45] Sep. 12, 1978

[54] METHOD OF MANUFACTURING INSULATING BOARD

[75] Inventors: Francis J. McGarry, Thompson; Donald Greene, Danielson; Jeffrey B. Otto, Brooklyn, all of Conn.

[73] Assignee: Rogers Corporation, Rogers, Conn.

[21] Appl. No.: 847,571

[22] Filed: Nov. 1, 1977

Related U.S. Application Data

[63] Continuation-in-part of Ser. No. 654,847, Feb. 3, 1976, abandoned.

[51] Int. Cl.[2] ..... D21F 11/08; D21J 1/04; D21J 1/20

[52] U.S. Cl. ..... 162/123; 100/38; 100/93 P; 162/206; 162/225; 264/113

[58] Field of Search ..... 162/123, 132, 204, 205, 162/206, 207, 225; 34/12, 14, 23; 100/38, 93 P; 264/113; 428/280, 282, 326, 534, 535, 536; 156/62.8

[56] References Cited

U.S. PATENT DOCUMENTS

| | | | |
|---|---|---|---|
| 1,172,244 | 2/1916 | Abbott | 428/535 |
| 2,802,403 | 8/1957 | Boehm | 162/206 |
| 2,924,548 | 2/1960 | Cotton | 162/132 |
| 3,021,244 | 2/1962 | Meiler | 162/123 |
| 3,054,717 | 9/1962 | Turner | 162/123 |
| 3,056,718 | 10/1962 | Grissom et al. | 162/225 X |
| 3,367,828 | 2/1968 | Carter et al. | 162/206 X |
| 3,468,755 | 9/1969 | Culp | 162/206 |
| 3,779,860 | 12/1973 | Oshida | 162/123 X |

FOREIGN PATENT DOCUMENTS

| | | | |
|---|---|---|---|
| 618,394 | 4/1961 | Canada | 162/123 |

*Primary Examiner*—Arthur L. Corbin

[57] ABSTRACT

A high density insulating board is produced by a process which includes forming a wet multi-ply board of fibrous material, substantially free of resin, on the roll of a wet cylinder machine, drying the board, placing the dry board in a press, and then hot pressing the board at a differential temperature of about 15° to about 40° F across the board for at least 30 seconds.

10 Claims, 1 Drawing Figure

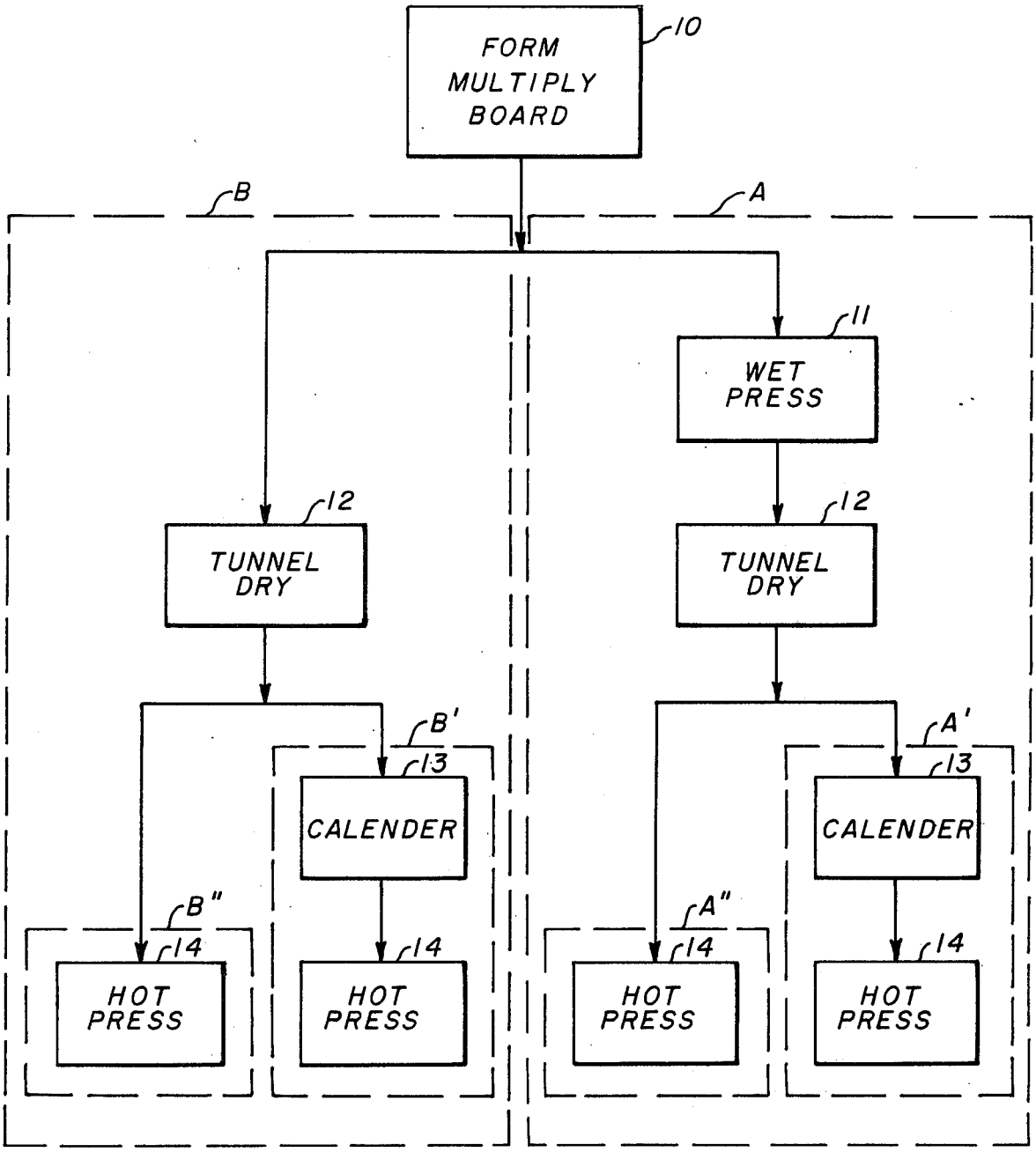
FORM MULTIPLY BOARD
10
B
A
WET PRESS
11
TUNNEL DRY
12
TUNNEL DRY
12
B'
13
CALENDER
A'
13
CALENDER
B"
14
HOT PRESS
14
HOT PRESS
A"
14
HOT PRESS
14
HOT PRESS

METHOD OF MANUFACTURING INSULATING BOARD

CROSS REFERENCE TO RELATED APPLICATION

This application is a continuation-in-part of U.S. application Ser. No. 654,847, filed Feb. 3, 1976, now abandoned.

BACKGROUND OF THE INVENTION

This invention relates to the field of high density boards and the method of manufacture of high density boards. More particularly, this invention relates to high density insulation boards and the method of manufacture thereof, particularly boards intended for use as insulating spacers in electrical power transformers.

As is well known, electrical power transformers having core form transformer coil assemblies require board material to serve as radial spacers and insulators. This board material, which is usually cellulose fiberboard, must meet certain requirements for compressibility properties. In particular, low deformation under load, i.e. low percentage compression, is the compressive property of particular interest. If the transformer board does not possess this desirable characteristic, the coil assemblies of the transformer are not dimensionally stable and performance characteristics of the transformer may be adversely affected by changes in the dimensional relationship between the coil assemblies as they move closer together upon compression of the spacer boards. In particular, a significant physical load is imposed on the boards by the coils when the transformer is operated. If the board does not resist deformation under the loading from the coils, the desired tightness and rigidity of the coils is lost; the coils become loose, and the coils may fail due to physical vibration or may come into contact and short out.

It has been believed in the art that desirable compressive properties for this insulating board are related to the density of the board, with the compressive properties improving, i.e. being more desirable, with increasing density of the board. This relationship between compressive properties and densities immediately suggests that desired compressive properties can be achieved merely by increasing the density of the board. While that may be generally true, there are, however, both practical and economic reasons which impose upper limits on the density of the board.

Several techniques have been known in the prior art for manufacturing the transformer board. In most or all of the techniques, multi-ply board is initially formed in conventional paper making manner on a wet cylinder machine; and the board in its initial wet form contains about 60% water, this being referred to as wet board. In one known prior art technique, the wet board is pressed in a cold press to remove, i.e. squeeze out, about half the water; the board is then dried in a tunnel dryer with circulating hot air to reduce the moisture content to about 6%; and the board is then calendered to density. In another prior art technique, the process described immediately above is followed with the exception that the cold pressing step is omitted and all drying occurs in the tunnel dryer. In a third known prior art technique, the wet multi-ply board is placed in a press between upper and lower sheets of woven wire fabric. The board is then pressed between the platens of the press which are steam heated, and the board is retained under pressure until the moisture content is reduced to a desired level. Moisture is removed both by the physical pressing of the board and by vaporization caused by the steam heated platens, the fluid escaping through the woven wire fabric on either side of the board. The compressive characteristics of board produced by this third technique of the prior art are somewhat superior to the compressive characteristics of the board of the same density produced by the first and second described techniques of the prior art.

As indicated above, it was previously believed that the compressive properties of the boards produced by these prior art techniques could be improved only by increasing the density of these boards. However, as previously discussed, there are both practical and economic limitations on the density values that can be achieved for the board.

SUMMARY OF THE INVENTION

In accordance with the present invention, insulating board, particularly suitable for use as transformer board, is produced by a novel and improved method, and the resultant board has unexpected and significantly improved compressive properties for a given density of board as compared to boards of the same density made in accordance with the prior art techniques. Restated, while it has previously been believed that improvement in compressive properties required an increase in the density of the board, it has been surprisingly and unexpectedly determined that in accordance with the present invention the compressive properties of the board can be significantly improved without requiring an increase in density. In accordance with the present invention, wet multi-ply board is formed on a wet cylinder machine and is either tunnel dried or both cold pressed and tunnel dried to reduce the water content from approximately 60% to the range of from 1–15%. Board having a moisture content of from 1–15% is considered to be dry board. If desired, the board may then be calendered after drying. The dry board (calendered or uncalendered) is then pressed in a hydraulic press with steam heated platens at a desired pressure and with a differential temperature across the board for a set period of time, and the hot pressed dry board is then removed from the press. Board produced in this fashion, i.e. dry board which is hot pressed at differential temperatures across the board, has unexpectedly and surprisingly been found to have substantially superior compressive properties at a given density than board of the same density produced by prior art processes. This achievement of improved compressive properties without the need to increase density is a totally unexpected and surprising result, and it represents an extremely important advance in the art of insulating board and methods of manufacture thereof.

Accordingly, one object of the present invention is to provide a novel and improved process for the formation of insulating board, particularly transformer board.

Another object of the present invention is to provide transformer board having significantly improved compressive properties at a given density.

Other objects and advantages of the present invention will be apparent to and understood by those skilled in the art from the following detailed description and drawings.

BRIEF DESCRIPTION OF THE DRAWINGS

The single FIGURE of the drawings shows a flow chart of the process of the present invention. In the drawing, two alternate processing paths are shown, and each path has another alternate path in it.

DESCRIPTION OF THE PREFERRED EMBODIMENT

In accordance with the present invention, multi-ply cellulose fiberboard is formed on a conventional wet cylinder machine in accordance with conventional and known techniques. The fibers in the aqueous slurry from which the board is to be formed are beaten to a desired freeness to obtain a desired rate of run-off of the water from the fibers during formation of the board. The slurry and the resulting board are substantially free of thermoplastic and thermosetting resins. The multi-ply board, which will typically have from 8 to 35 plies, will contain about 60% water when initially formed, that board being referred to as "wet" board. Formation of the board is depicted in step 10 of the drawing.

The wet board is removed from the making roll of the cylinder machine and then dried to reduce the moisture content to the range of from 1–15%, preferably from 3–10%, and most preferably about 7%. The board with the moisture content reduced to 15% or below is essentially in a dry state and will be referred to as "dry" board. An important point to note is that for the rest of the process of the present invention, the board is dry and it is considerably easier to handle in the step of loading it into the press than the wet board of the third prior art process discussed above. In addition, since the board is dry, woven fabric is not required between the board and the press platens to provide a means of escape for moisture. The step of drying the board may be accomplished in any suitable fashion, the drying step presenting possible alternate paths in the process indicated in the dashed lines A and B. For example, as shown in path A, the wet board may first be cold pressed in step 11 and then dried in a tunnel dryer in step 12; or, as shown in path B, the board may just be tunnel dried in step 12. After drying, the dry board may be calendered if desired. The dry board (whether calendered or not) is then placed between the platens of a press for hot pressing, the platens being steam heated to obtain platens of desired different temperatures to effect a differential heating across the board. Calendering step 13 and hot pressing step 14 are shown in alternate subpaths A′ and B′, while hot pressing step 14 alone is shown in alternate paths A″ and B″. Asymmetric pressing of the board by differential heating in the hot press has been determined to be of critical importance to produce an acceptable product. Pressing of the board with platens of equal temperature resulted in warped board because there was greater shrinkage of the board on the roll side (i.e. the side in contact with or nearest the cylinder or making roll when the board is formed) than on the felt side (i.e. the side which is away from the cylinder or making roll) and receives the next layer from the felt belt. Although the reason for this warpage is not fully understood, one theory is that fibers of board plies nearer the making roll tend to become more uniformly oriented along the length of the board (i.e. in the direction of circumference of the roll) because they are spun or rotated more times than outer plies; and shrinkage increases perpendicular to fiber orientation, so the roll or inner side experiences greater shrinkage than the felt or outer side, with a resulting buildup of uneven stresses in the board leading to warpage.

Whatever may be the cause of the warpage, it has been determined that the problem can be cured by differential heating of the board in the hot press step, with the press platen being hotter on the felt or outer side of the board than on the roll or inner side of the board. For board ranging in thickness from about 60 to 200 mils, it has been determined that a preferred temperature differential is about 20° F. (about 11° C.) with the felt or outer side being heated to about 280° F. (about 140° C.) and the roll or inner side being heated to about 260° F. (about 125° C.). Pressing pressure is preferably about 600 psi. Also, to minimize the time available for warping to occur, pressing time should be preferably around 1 minute.

While it is critical to maintain a temperature differential across the board with the felt or outer side being at a higher temperature than the roll or inner side, the parameters of temperatures, temperature differentials, time and pressure may vary within ranges and/or various thicknesses of board. For board in the range of 60 to 200 mils thick, the temperature differential across the board may range from a high of about 40° F. to a low of about 15° F., but any greater or lesser differential is not acceptable. The hotter press platen may have a range of from 235° F. to 450° F., and the other platen may range in temperature from 220° F. to 435° F. Pressure may vary from 100 to 2000 psi, and press time may range from ½ minute up to 30 minutes, although press time should be minimized both to reduce the time for warpage to occur and for economic reasons in maximizing the flow of material through the press.

At the conclusion of the hot pressing operation, the hot pressed dry board is then removed from the press and it is ready for use as transformer board or for other suitable insulating purposes. The insulating board produced in accordance with the present invention has demonstrated extremely unexpected and surprising compressive properties. Expectations based on the known state of the art were that the compressive properties of the board would be a function of or related to the density of the board, with denser board being required to achieve improved compressive properties. However, it was unexpectedly and surprisingly discovered that board produced in accordance with the present invention has significantly superior compressive properties than board produced by the prior art techniques for the same density of each board. Bearing in mind that additional processing and expense, both of which may sometimes be considerable, may be involved in achieving increased density, the significance of the unexpected results of the present invention can be appreciated. Significantly improved compressive properties can be obtained without the complications and expense of producing board of higher density; or, conversely, less dense board can be produced while still maintaining desired compressive properties.

Deformation under load (i.e. percent compression) is the compressive property of primary interest in determining the effectiveness of the present invention, with reduced deformation (i.e. a reduction in percent compression) being desirable. The realization of this improved compressive property with the present invention is illustrated in the following examples wherein boards produced in accordance with the present invention are compared with boards produced in accordance with prior art techniques. For comparison purposes, prior art boards were used which had been produced by three prior art methods: (1) tunnel drying; (2) cold wet pressing and tunnel drying; and (3) hot wet pressing. The density and deformation properties of the prior art boards and the boards of each of the examples of the present invention are listed in the table below. Boards 1–5 were made by prior art techniques, while Examples 6–15 show boards made in accordance with the present invention. Examples 6–15 show an improvement in deformation (i.e. reduced compression) relative to the prior art of Examples 1–5 ranging from a minimum of about 20% to a maximum of about 70% before aging and an improvement ranging from a minimum of about 10% to a maximum of about 70% after aging. Similarly, Examples 16 and 17 show an improvement in deformation relative to the prior art ranging from a minimum of about 15% to a maximum of about 72% before aging and an improvement ranging from a minimum of about 13% to a maximum of about 67% after aging. An improvement of 10% in deformation properties is a significant improvement in the board, and an improvement of up to 70% is of marked significance. Thus, board produced in accordance with the present invention is of particular utility in transformers to establish and maintain the desired tightness and rigidity of the transformer coils.

While preferred embodiments have been shown and described various modifications and substitutions may be made thereto without departing from the spirit and scope of the invention. Accordingly, the present invention has been described by way of illustration and not limitation.

What is claimed is:

1. A process of forming insulating board comprising the steps of:

forming a wet multi-ply board of fibrous material, substantially free of resin, the board being formed on the roll of a wet cylinder machine;

drying the multi-ply board to reduce the moisture content thereof to about 1 to about 15%; and asymmetrically hot pressing the dry board by pressing and heating the felt side of the board at a first predetermined temperature and pressing and heating the roll side of the board at a second predetermined temperature, the first predetermined temperature being higher than the second predetermined temperature to establish a temperature differential of about 15° F. to about 40° F. across the board, the asymmetric hot pressing being under pressure and occurring for at least 30 seconds.

2. A process of forming insulating board as in claim 1 wherein:

| EXAMPLE: | 1[1] | 2[1] | 3[1] | 4[1] | 5[1] | 6 | 7 | 8 | 9 |
|---|---|---|---|---|---|---|---|---|---|
| Cold Wet Pressing, psi/min. | No | 390/45 | No | No | No | No | No | No | No |
| Tunnel Dried | Yes | Yes | No | No | No | Yes | Yes | Yes | Yes |
| Calendered | Yes | Yes | No | No | No | No | No | Yes | Yes |
| Hot Pressed | No | No | No | No | No | Yes | Yes | Yes | Yes |
| Time, min. | — | — | — | — | — | 8 | 8 | 4 | 8 |
| Platen Temp.° C[2] | — | — | — | — | — | 138 | 138 | 138 | 138 |
| Pressure, psi | — | — | — | — | — | 1000 | 2000 | 1000 | 1000 |
| Hot Wet Pressed | No | No | Yes | Yes | Yes | No | No | No | No |
| Time, min. | — | — | 35 | Unknown | | — | — | — | — |
| Platen Temp. ° C | — | — | 160 | Unknown | | — | — | — | — |
| Pressure, psi | — | — | 750 | Unknown | | — | — | — | — |
| Density, Mg/m³ | 1.00 | 1.19 | 1.18 | 1.20 | 1.25 | 1.06 | 1.16 | 1.16 | 1.15 |
| % Compression[3] from .3–3 kpsi load | 9.5 | 4.3 | 4.2 | 4.1 | 4.7 | 3.2 | 2.8 | 3.2 | 2.8 |
| after aging[4] | 14.2 | 7.0 | 6.3 | 6.5 | 7.0 | 5.5 | 4.2 | 5.7 | 5.07 |

| EXAMPLE: | 10 | 11 | 12 | 13 | 14 | 15 | 16 | 17 |
|---|---|---|---|---|---|---|---|---|
| Cold Wet Pressing, psi/min | 390/45 | 390/45 | 45 | 390/45 | 390/45 | 390/45 | 390/45 | 390/45 |
| Tunnel Dried | Yes | Yes | Yes | Yes | Yes | Yes | Yes | Yes |
| Calendered | No | Yes | Yes | Yes | Yes | Yes | Yes | Yes |
| Hot Pressed | Yes | Yes | Yes | Yes | Yes | Yes | Yes | Yes |
| Time, min. | 4 | 8 | 8 | 8 | 8 | 2 | 1 | 0.5 |
| platen Temp. ° C[2] | 116 | 116 | 138 | 116 | 116 | 116 | 138/128 | 138/128 |
| Pressure, psi | 1000 | 500 | 500 | 250 | 1000 | 1000 | 590 | 590 |
| Hot Wet Pressed | No | No | No | No | No | No | No | No |
| Time, min. | — | — | — | — | — | — | — | — |
| Platen Temp.° C | — | — | — | — | — | — | — | — |
| Pressure, psi | — | — | — | — | — | — | — | — |
| Density, Mg/m³ | 1.18 | 1.21 | 1.25 | 1.23 | 1.26 | 1.24 | 1.26 | 1.25 |
| from .3–3 kpsi load | 3.2 | 3.1 | 2.8 | 3.3 | 2.7 | 3.1 | 2.6 | 3.5 |
| after aging[4] | 5.6 | 5.1 | 4.4 | 5.6 | 4.3 | 5.2 | 4.6 | 5.5 |

[1] Examples of prior art boards.
[2] Temperatures for Examples 16 and 17 show differential heating of the board (feltside/rollside) with the felt or outer side being at a higher temperature than the roll or inner side.
[3] Testing according to British Standard 231: 1967; Specification for Pressboard for Electrical Insulation.
[4] Aging is in transformer oil, under load, at 105° C. for 24 hours—load is 3 kpsi applied in a fixture immersed in transformer oil.

said first predetermined temperature is from about 235° F. to about 450° F. and said second predetermined temperature is from about 220° F. to about 435° F.

3. A process of forming insulating board as in claim 1 wherein:

said temperature differential is about 20° F.

4. A process of forming insulating board as in claim 3 wherein:

said first predetermined temperature is about 280° F. and said second predetermined temperature is about 260° F.

5. A process of claim 1 wherein:

the pressure is from about 100 to about 2000 psi.

6. A process of claim 5 wherein:

the pressure is about 600 psi.

7. A process of claim 1 wherein:

the time is from about 30 seconds to about 30 minutes.

8. A process of claim 7 wherein:

the time is about 1 minute.

9. A process of forming insulating board comprising the steps of:

forming a wet multi-ply board of fibrous material substantially free of resin, the board being formed on the roll of a wet cylinder machine;

drying the multi-ply board to reduce the moisture content thereof to about 1 to about 15%; and asymmetrically hot pressing the dry board at a differential temperature of about 20° F. by pressing and heating the felt side of the board at a temperature of about 280° F. and pressing and heating the roll side of the board at a temperature of about 260° F., the asymmetric hot pressing being at a pressure of about 600 psi for about 1 minute.

10. A process as in claim 9 wherein:

the moisture content is about 7%.

* * * * *